United States Patent [19]

Mori

[11] Patent Number: 5,012,754

[45] Date of Patent: May 7, 1991

[54] OPEN-BOTTOM GRAVEL DUMP BOAT

[75] Inventor: Toshifumi Mori, Hyogo, Japan

[73] Assignee: Marusen Co., Ltd., Hyogo, Japan

[21] Appl. No.: 72,265

[22] PCT Filed: Nov. 5, 1986

[86] PCT No.: PCT/JP86/00559

§ 371 Date: Sep. 8, 1987

§ 102(e) Date: Sep. 8, 1987

[87] PCT Pub. No.: WO87/02960

PCT Pub. Date: May 21, 1987

[30] Foreign Application Priority Data

Nov. 8, 1985 [JP] Japan ..... 60-251514

[51] Int. Cl.[5] ..... B63B 35/28

[52] U.S. Cl. ..... 114/36; 114/26; 414/137.3

[58] Field of Search ..... 114/26–36; 414/137.3, 137.7; 222/504

[56] References Cited

U.S. PATENT DOCUMENTS

| | | | |
|---|---|---|---|
| 279,683 | 6/1883 | Wilson | 114/29 |
| 357,857 | 2/1887 | Rogers | 114/36 |
| 2,444,299 | 6/1948 | Koenig | 114/29 |
| 3,509,841 | 5/1970 | Boer | 114/29 |
| 3,596,621 | 8/1971 | Werenskiold | 114/29 |

FOREIGN PATENT DOCUMENTS

| | | | |
|---|---|---|---|
| 079789 | 6/1980 | Japan | 114/29 |
| 56-79082 | 6/1981 | Japan | 114/29 |
| 639755 | 4/1979 | U.S.S.R. | 114/29 |
| 0765105 | 9/1980 | U.S.S.R. | 114/29 |

*Primary Examiner*—Ed Swinehart

[57] ABSTRACT

A hull construction of a cargo carrier vessel, with self-propelling capacity, capable of carrying earth, sand, quarried stones and so forth and of disposing of them from the bottom is disclosed. While the bottom (11) is released, the hold forms a double-hull construction with side walls (12). A pair of right and left doors, each with an L-shaped section, is provided. The upper part of each door is connected by hinges to outsides of the side walls of said hold. The doors curve and extend along the released bottom. Cargo is carried in the hold (1). Furthermore, a door structure to dispose of cargo from the released bottom into the sea by releasing it to the right and left and equipment to open and close the pair of doors, located at the front and back of the door structure, is provided.

10 Claims, 18 Drawing Sheets

RIGHT-TURN TRIAL

OPEN-BOTTOM GRAVEL DUMP BOAT

BACKGROUND OF THE INVENTION

1. Field of the Invention

The present invention relates to the hull construction of hopper barge carrier vessels or boats used to convey gravel and crushed or quarried stones and dump them.

2. Description of the Prior Art

Vessels for marine civil engineering can be divided into roughly two types: the carrier vessel, which has a self-propelling capacity, and the pusher barge vessel, which does not. Generally, the former carrier vessel's self-propelling capacity results in high operational speed, but as loading and unloading of gravel and quarried stones are done by a crane or the like, its inefficiency, especially during unloading, constitutes a problem point. The latter pusher barge vessel has the disadvantage of low operational speed due to its lack of a self-propelling capacity, and must, therefore, be pushed by a pusher. However, as loads such as gravel or quarried stones can be disposed into the sea by opening the bottom, this vessel has the advantage of efficient unloading operations.

Accordingly, if it becomes possible to add an unloading function by opening the bottom of a carrier vessel with self-propelling capacity, the vessel's conveying and dumping potential can be maximized.

At present, however, as the constitutions of pusher barge vessel unloading hulls are of either the so-called hopper barge style, in which a bottom plate hung on chains or the like is released to unload, or the so-called full open style, in which sections of the hull connected to the hull by hinges are released to unload, neither can be applied to a carrier vessel due to hull construction. More concretely, an ore carrier, as an example of a carrier vessel with self-propelling capacity, is designed so that both sides of the double bottom DB are ballast tanks BT; thus ore can be loaded in the middle of hold HO, as illustrated in FIG. 29. In another example, the grain carrier, as illustrated in FIG. 30, is designed so that ballast tanks BT on both sides of the double bottom DB are made smaller to ensure voluminous hold capacity, while triangular ballast tanks, called shoulder tank ST, are provided at both upper sections of port and starboard and hatch HA is provided as supplementary equipment. Moreover, as illustrated in FIG. 31, the ore bulk oil carrier (OBO) is designed so that pipe tunnel PT is provided in the middle of double bottom DB with ballast tanks BT at both sides. Ore is not loaded in every hold; rather a loading method called alternate loading, in which completely empty holds and fully-loaded holds are alternated, is applied. In this way hull construction is devised according to cargo characteristics.

Moreover, even if the unloading hull construction of the above-mentioned pusher barge vessels is applied, it is difficult to maintain operational speed as a carrier vessel. When the above-mentioned hopper barge pusher barge vessel is in an unloading position, disposal is difficult in shallow seas as the bottom plate protrudes from the lower part of the bottom. Additionally, the construction requires that the bottom plate be hung, and a problem arises in that the weight of loaded cargo applies direct force, thus necessitating relatively large-scale equipment. On the other hand, although the part which protrudes from the hull is small in full open style vessels, a problem lies in fact that the type of machinery and equipment which are usually placed on deck and their placement positions are limited because the hull is separated structually and the deck does not run the full length of the vessel from stem to stern.

OBJECT OF THE INVENTION

The first object of the invention is to provide a hull construction suitable for a carrier vessel which can also be used as an ordinary cargo ship, and which does not pose the problem of limited sea area for disposal and equipment scale, as in the case of the hopper barge unloading hull construction of conventional pusher barge vessels, and which is not restructed in terms of machinery and equipment, as is the case in the full open style.

The second object of the invention is to provide a carrier vessel hull construction for hopper barge which avoids bringing excessive loaded cargo weight to bear on the door opening and closing structure, and, thus, makes it easy to open and close the door.

The third object of the invention is to provide a carrier vessel structure with a new hopper barge style in which loadage capacity is large and which also permits a sailing speed equal to an ordinary carrier vessel by applying the above hopper barge hull construction to a double-deck or multi-deck carrier vessel.

The fourth object of the invention is to provide a completely watertight structure in tandem with the above hopper barge hull construction, such as is usually required of a cargo carrier vessel.

The fifth object of the invention is to provide equipment suitable for opening and closing the doors at the opened bottom of the hold in the above hopper barge hull construction.

SUMMARY OF THE INVENTION

The first structure of the invention is to release the bottom 11 of the hold (1) and to form a hull by making side walls 12 of double hull construction, as illustrated in FIG. 1 to 3, in order to maintain a single body structure from stem to stern, thus differing from the conventional pusher barge vessel unloading hull construction, with a full open style in which the hull is separated. In addition, a pair of right and left sectionally L-shaped doors 21, 21, the upper parts of which are connected to the outside of each side wall of the hull by hinges and which curve inward to released bottom 11, open and close sideways so that the amount of protrution is not large, as in conventional pusher barge vessels. These doors make it possible to store cargo in the hold by closing the released bottom of said hold, and to dispose of it into the sea through the released bottom by the pair of said doors moved sideways by means of a small amount of drive.

In the preferred embodiment of the present invention, the structure of said doors 21, 21, gives buoyancy, like a float-shaped structure, to the center of the width of the released bottom 11 on which the cargo rests; thus perpendicular load is mitigated. However, a structure which provides floats around the part contiguous to the cargo and which is reinforced by ribs is also applicable. Moreover, the preferred door exterior plate has an L-shaped section which curves alongside the hull shell plate.

The side walls 12 of the cargo hold, which form a double hull construction, can be applied either to a double-deck structure or a multi-deck structure. Further, the preferred embodiment of the interior is tapered to mitigate the perpendicular load which bears directly on the above stated doors.

Either horizontal cylinders, which expand and contract sideways, or perpendicular cylinders, which expand and contract lengthwise, will be used as the driving means (3) for spreading the above pair of doors to the right and left; during opening and closing of the doors, rotatably-supported perpendicular cylinders move and swing the doors. Air pressure, water pressure or the like can be used as a hydraulic source, but oil pressure is generally used.

Moreover, the cylinders should be placed in cylinder spaces in the hold (1), at the stem (5) and the stern (6), so that cylinder placement will not interfere with unloading from the released bottom. Further, a pair of front and back driving means (3), (3) should work to open and close the doors evenly.

The second structure of the present invention is to facilitate the opening and closing of said doors without bringing excessive cargo weight to bear on the door opening and closing structure, as shown in FIG. 4.

It is characterized by a tapered structure capable of receiving L1, the greatest component of the total load space and weight L, on the inside of the side walls 12 of the hold (1) with the released bottom, and by a pair of right and left float-conditioned door structures (2), the upper part of each of which is connected at the outside of the side wall of the hold by hinges (4); the opening and closing doors 21, 21 at the hold bottom receive the remaining cargo space and weight L2 and have an L-shaped section curving toward the released bottom part, so that said float makes door closing power F received from the sea and said remaining cargo space and weight L2 balance each other.

The third structure of the present invention is to provide a new hopper barge carrier vessel construction with large loadage capacity, which also can sail at a speed equal to an ordinary carrier vessel, by applying said hopper barge hull construction to a double-deck or multi-deck structure, as shown in FIG. 5:

It is characterized by the fact that while it is of double-deck or multi-deck structure with an upper deck UP and deck FD from stem to stern in the double-hull construction hold (1), the external form of the hull below the water line forms a single body from stem to stern, as a pair of doors 21, 21 are placed where the double-hull construction below the water line DLWL is divided into right and left halves at the bottom center, thus forming a pair of float-conditioned right and left door structures with an L-shaped longitudinal section, which open and close to the right and left.

The fourth structure of the present invention is to provide a completely watertight structure in said hopper barge hull construction, as shown in FIG. 6:

The door with an L-shaped longtitudinal section attaches tightly to the outside of side walls 12, covering the open bottom 11 of the side walls 12 of the cargo hold (1) from both sides, thus forming a reverse trapezoidal cargo space in a double-hull construction. Furthermore, packing member (8) is provided around the inside edge of the pair of right and left doors 21, 21 of float-shaped door structure (2), and at the extremities of doors 21, 21, where both tip parts of the L-shaped doors can be attached. It is characterized by a water-tight structure formed by allowing door-closing force F, which said float-shaped door structure receives from the sea, to press against the parts connected to stem (5) and to stern (6), against the outside of the hold, and against the tip parts of the doors.

The fifth structure of the invention is for a hopper barge hull construction in which, while the bottom part 11 is released, the hold (1), constituting a double hull construction with side walls 12 and a pair of right and left doors 21, 21 with an L-shaped section curving alongside of the released bottom and the upper part of each of which is connected to the outside of both side walls of the said hold by hinges. This fifth structure can carry cargo by closing the released bottom of said hold, and dispose of cargo from the released bottom, by releasing it to the right and left, as shown in FIG. 17 to 20.

Door opening and closing equipment (3) is provided in the space SP between the stem section in the front hold (1) and the stern section (6) in the back hold (1). This said equipment is constructed to open and close said pair of right and left doors 21, 21 using opening-closing cylinders 31, 31. Further, engaged parts 33, 33 are provided at each said door 21, 21 and engaged lever 34, engaged to said engaged part, is operated rotatably via attachment oil pressure cylinder 35 so as to maintain a closed position or release the closed pair of doors 21, 21.

In order to execute smooth and sure opening, closing, attaching and releasing of said pair of doors 21, 21, it is preferable to provide a balance weight 36 for opening and closing and a balance weight 36' for attachment. Moreover, it is preferable to open, close, attach and release said pair of doors automatically by location detection using limit switches provided at required points.

An explanation of the overall concept of the present invention based on its basic plan, and detailed explanations based on embodied examples of each part are described below.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIG. 7 is a side view of the hull; FIG. 8 is a plan of the center part of the upper deck; FIG. 9 is a plan of the center part of the freeboard deck; FIG. 10 is a plan of the hold. FIG. 11 is a side cross section of the hold;

FIG. 13 is a longitudinal cross section of a center line through the middle of the hull; FIG. 14 is a plan view showing the structure of the upper deck UP; FIG. 15 is a plane view showing the freeboard deck structure; FIG. 16 is a plane view showing the structure of the inside of the hold bottom;

FIGS. 21 through 26 show the position of cargo, fresh water, sea water, fuel oil and lubricant oil in light load condition at the time of weight-center gravity calculation, at departure in full load condition, at 80% consumption in full load condition, and at port entry in full load condition, respectively; FIGS. 27 and 28 are graphs showing results of left- and right-turn trials during sea test operation;

DETAILED DESCRIPTION OF THE PREFERRED EMBODIMENTS

Figure 1:
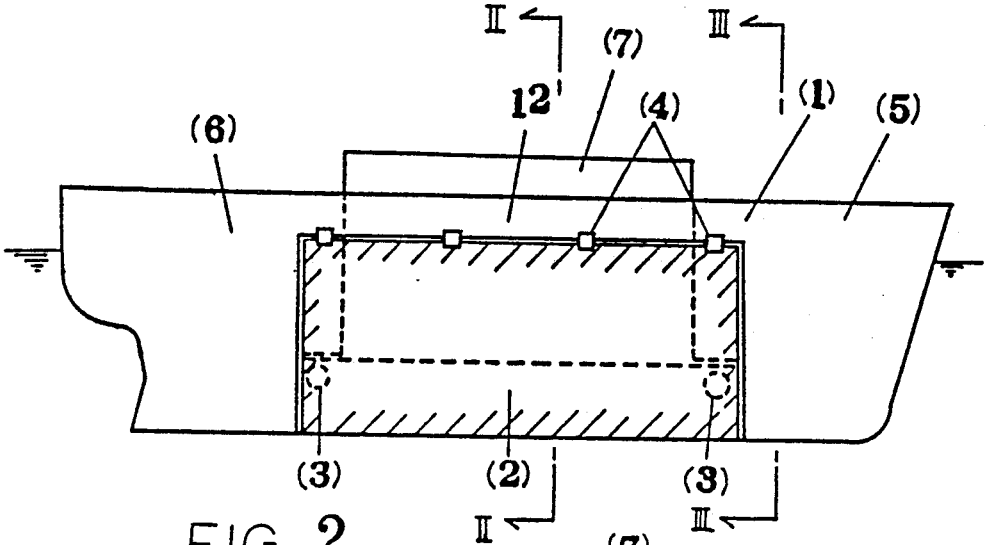
FIG. 1 is a side view of a carrier vessel embodied in the first structure of the present invention.
Figure 2:
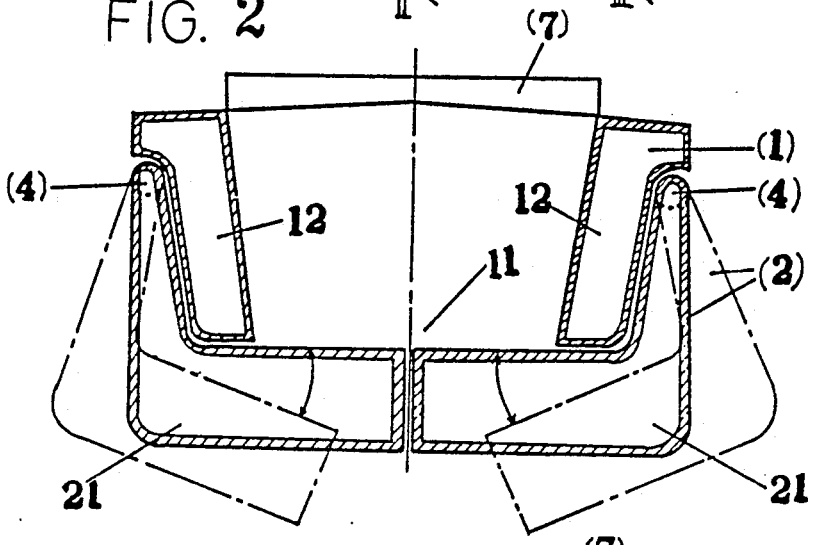
FIG. 2 is a cross section taken along line II—II in FIG. 1 and shows the door structure opening and closing conditions.

FIG. 1 shows the side view of a carrier vessel hull construction applying the basic structure of the present invention while FIG. 2 shows a cross section taken along line II—II illustrating the opening and closing conditions of the door structure. In FIG. 3*a* transverse section taken along line III of FIG. 1 shows horizontal cylinder operation in door opening and closing conditions located in the middle of the hold (1) between the stem (5) and the stern (6) of a cargo vessel S. While the bottom 11 is released, side walls 12, 12 consist of a double-hull construction and the inside of side walls taper inward toward the bottom.

On the other hand, door structure (2) opens and closes the bottom 11. It consists of a pair of right and left doors 21, with an L-shaped section, curving alongside the released bottom 11 and being connected by hinges at each upper end part each L-shaped door having a first leg which closes the opening when in the closed position, and a second leg positioned laterally outwardly of the side wall section. Said doors 21, 21 close the released bottom 11 of said cargo hold, and form a float so that buoyancy, which lifts the center of the released bottom attached to the doors, can be provided to keep cargo in the hold. Cargo is disposed into the sea from the released bottom 11 by means of spreading said pair of doors 21, 21 to the right and left. Horizontal oil pressure cylinders (3), which expand and contract horizontally at the front and back of said door structure as illustrated, are preferably provided as a driving means so that the drive for opening and closing moves the entire door section 21 in a well-balanced way. Further, a frame body (7) surrounds the upper mouth of the cargo hold.

Figure 3:
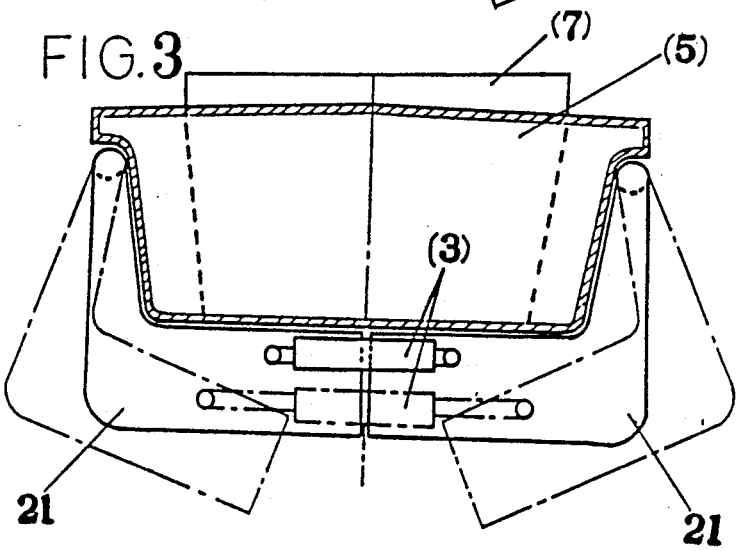
FIG. 3 is a cross section taken along line III—III in FIG. 1 and shows horizontal cylinder operation during door opening and closing.

In a hull construction of the above-mentioned structure, as shown in FIGS. 2 and 3 by said lines, earth, sand, quarried stones and the like are loaded in the hold (1), the pair of doors 21, 21 are closed and horizontal cylinders (3) and so forth keep them closed. The greater component of the perpendicular load is then distributed at side wall slope as lateral components of a force. The remaining load bears on the loading part of the pair of doors 21, 21. However, because the pair of doors 21, 21 constitutes a float and because the buoyancy pushes up the middle of the released bottom 11, the load bearing on the loading part of said pair of doors 21, 21 is mitigated, and the stress on the hinge structure of the door part is greatly mitigated.

Thus, because a cargo vessel loading earth, sand and the like consists of a single body from stem (5) to stern (6) with side walls of a double steel hull construction, it can carry cargo to a destination under ordinary sail, in spite of said cargo disposal hull construction.

At the destination, the bottom of the hold (1) is easily released because when a pair of doors 21, 21 is spread to the right and left via horizontal cylinders (3), the perpendicular load of cargo exceeding buoyancy on the doors effects said pair of doors. Thus, cargo in the hold (1) is disposed into to sea. After disposal, the pair of doors 21, 21 naturally returns to the condition it was in because of said buoyancy. Accordingly, horizontal cylinders (3) are contracted so that the released bottom 11 of the hold (1) is easily closed.

FIGS. 7 through 20 show plan drawings for production of an actual hull construction, embodying the above basic ideas. In the drawings, numbers identical to those given to parts in FIGS. 1 through 3 showing the basic forms are used.

In the drawings, the hold section (1) is located in the middle part between the stem section (5) and the stern section (6) which comprises the main body. While the bottom section 11 is released, the side walls 12, 12 facing each other are of double-hull construction and the inside of the walls forms a tapered slope which narrows towards the bottom, and which, as a whole, forms reverse trapezoidal cargo area CA.

Figure 7:
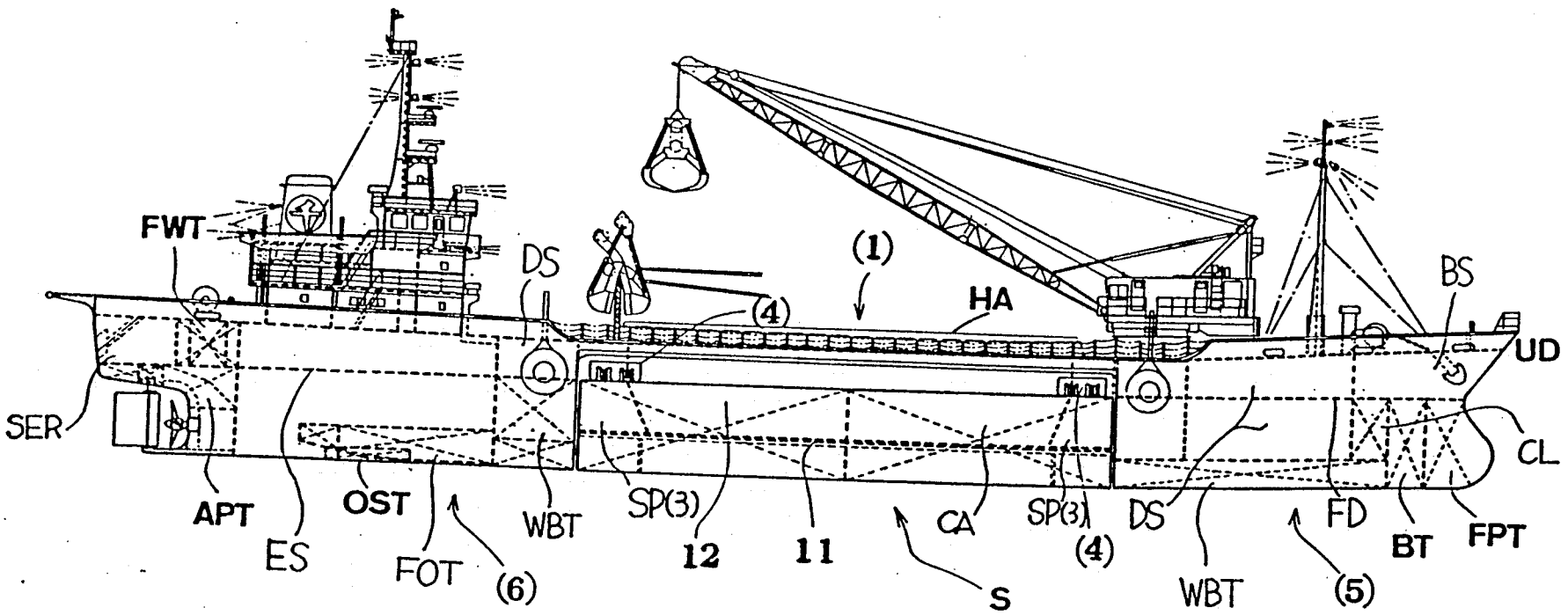
FIGS. 7 through 11 illustrate optimal general placement views in carrier vessel for the present invention.

In the stem section (5), shown in FIG. 7, bosen store BS and deck store DS are located between the upper deck and the freeboard deck. Below the freeboard deck FD, there are, from the stem, forepeak tank FPT, bow thruster room BT, chain locker CL, and deck store DS, in that order. Water ballast tank WBT is located in the lowest double bottom section. Cargo crane SE 360 LG is positioned on the upper deck UD.

On the other hand, in the stern section (6), steering room and crew space are located on the upper deck UD, and deck store DS, engine space ES, fresh water tank FWT, and steering engine room SER are located between the upper deck UD and the freeboard deck FD. Below the freeboard deck FD, there are water ballast tank WBT, engine space ES, and afterpeak tank APT. Water ballast tank WBT, fuel oil tank FOT and lubricating oil tank OST are located in the lowest double bottom.

Figure 8:
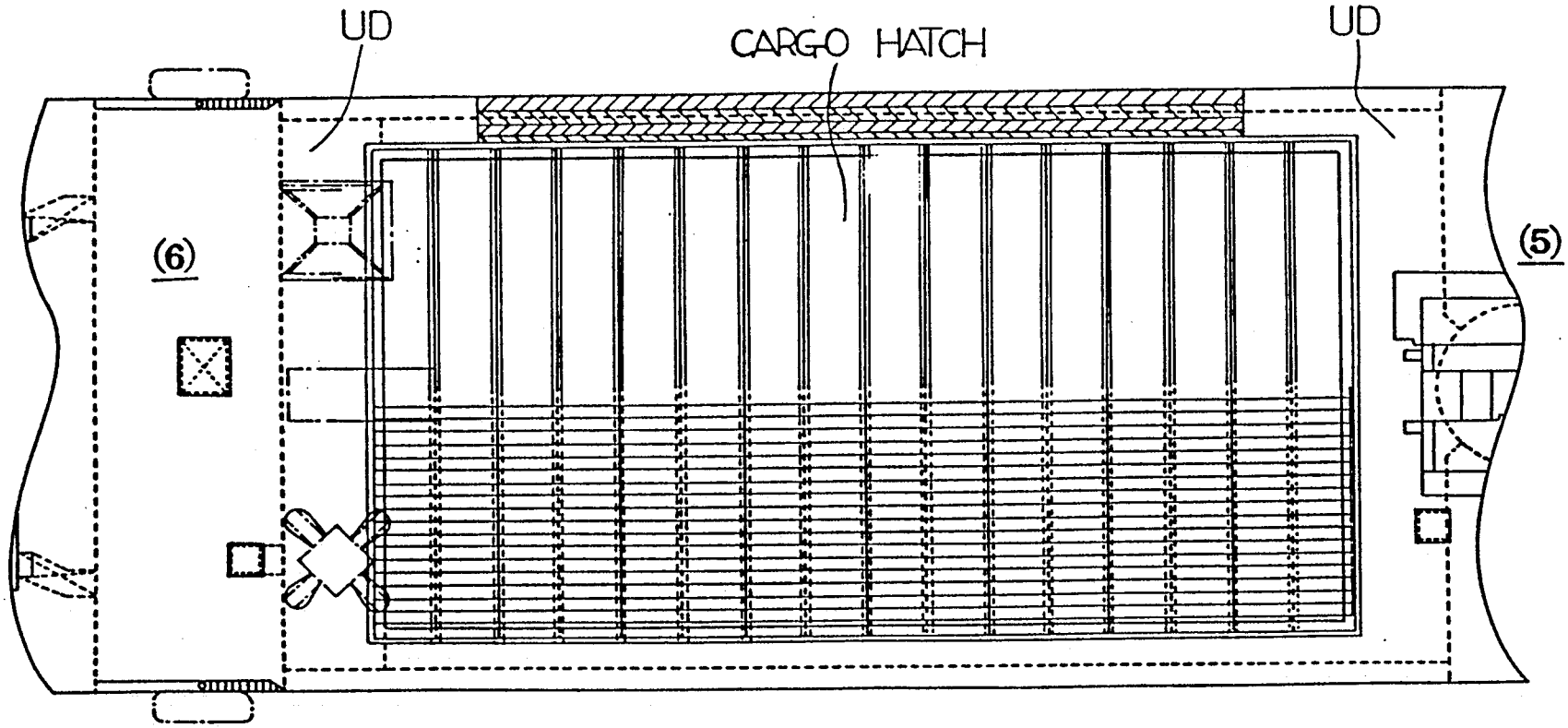
Figure 9:
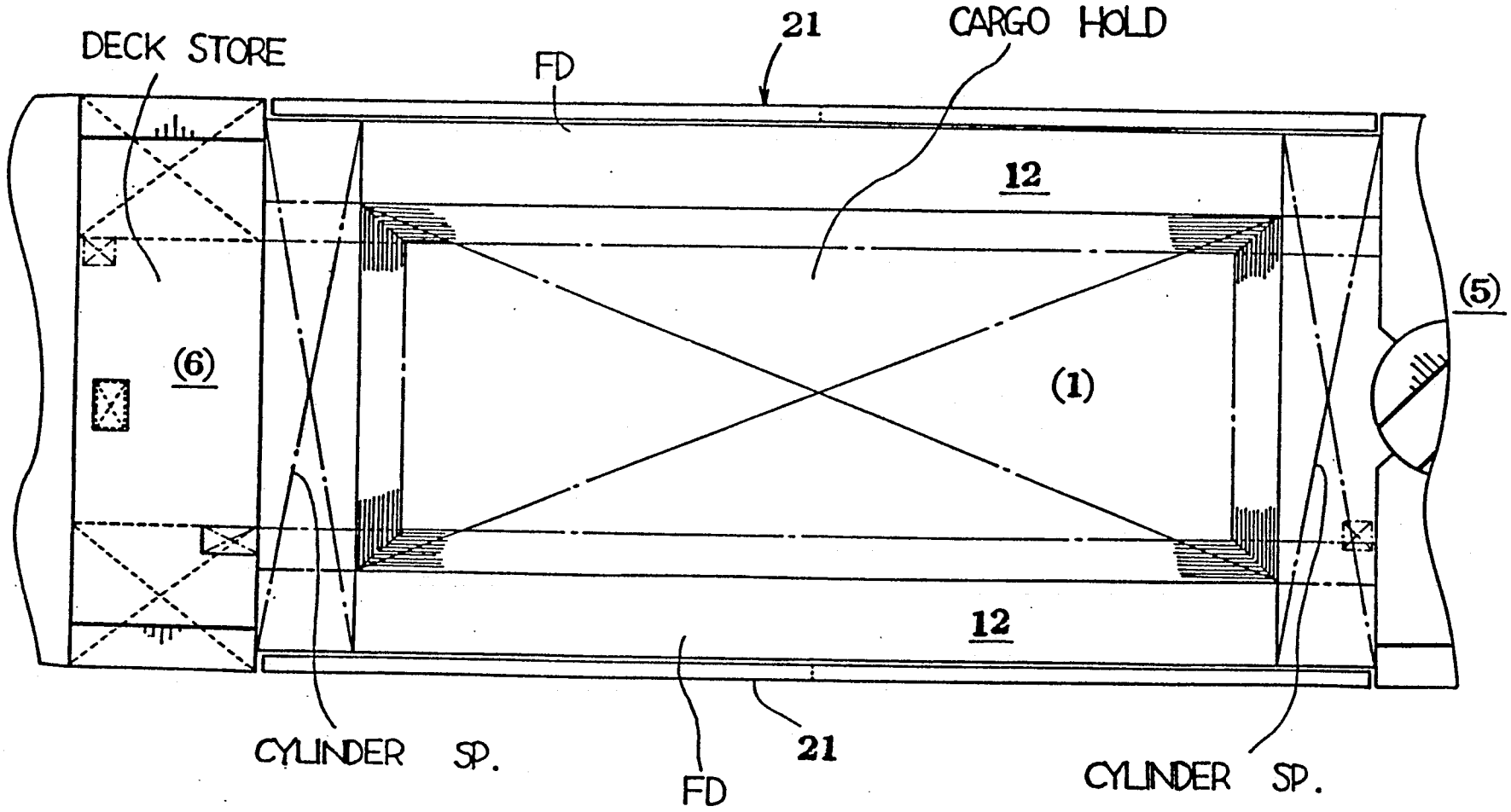
Figure 10:
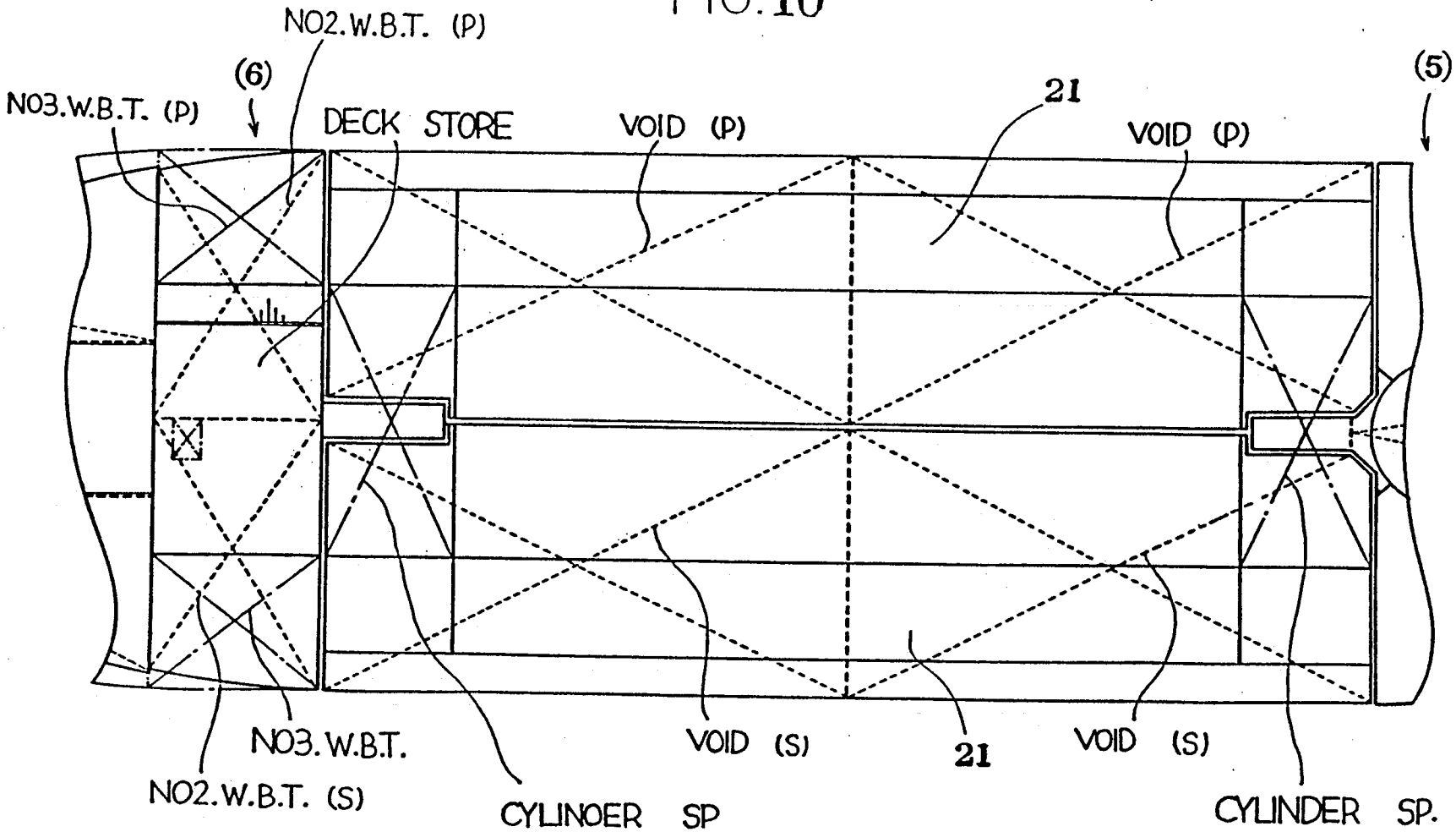
Figure 13:
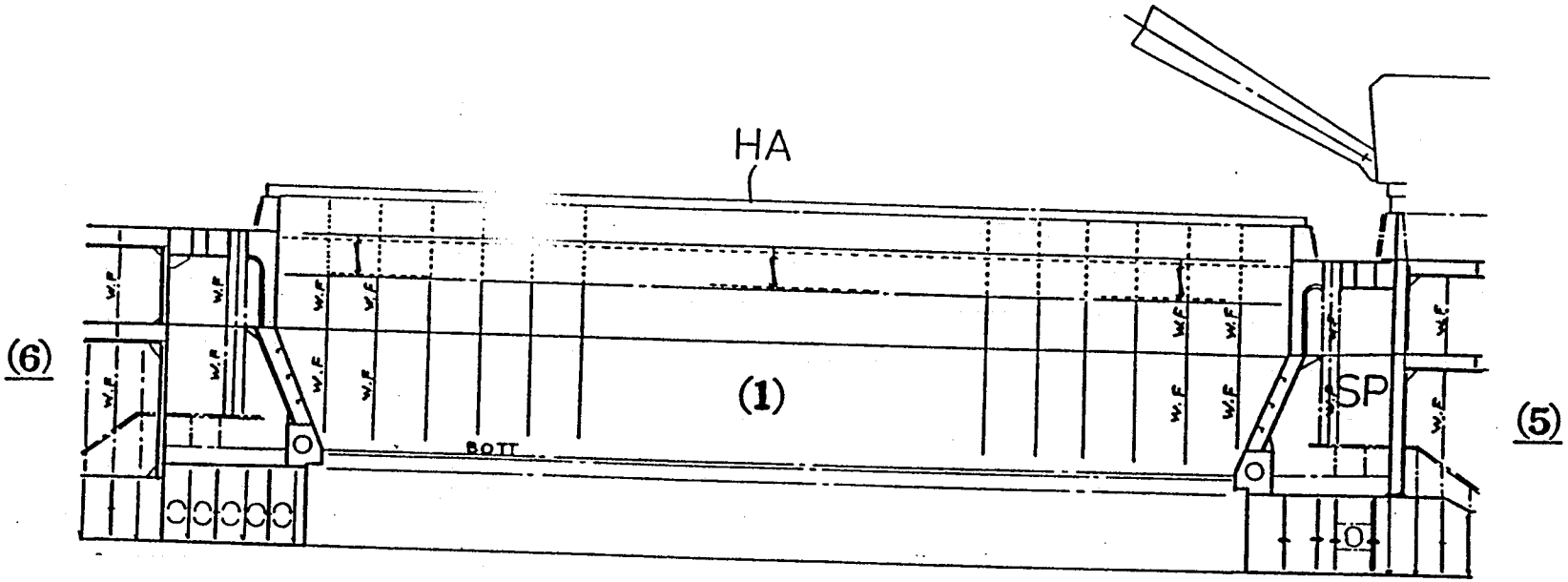
FIGS. 13 through 16 are construction profiles and plans showing hull construction.
Figure 14:
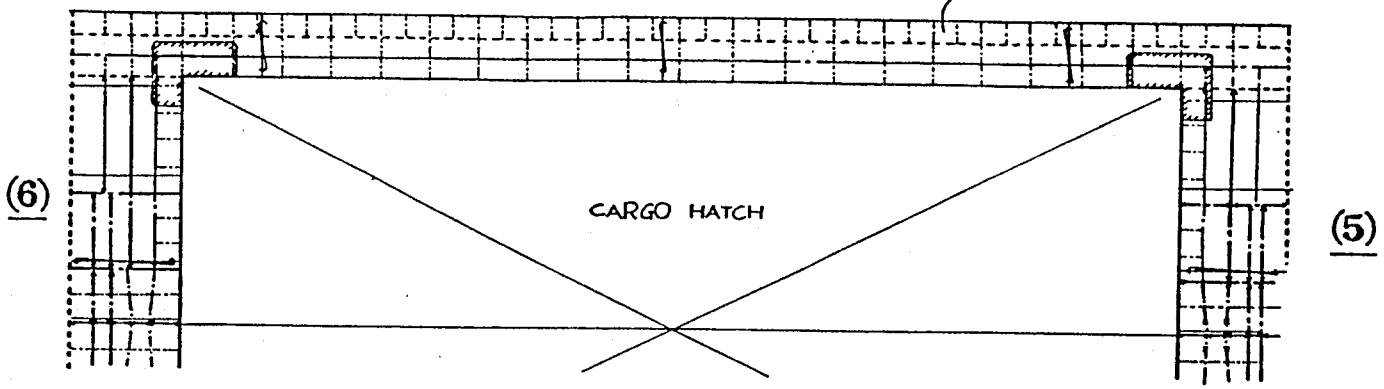
Figure 15:
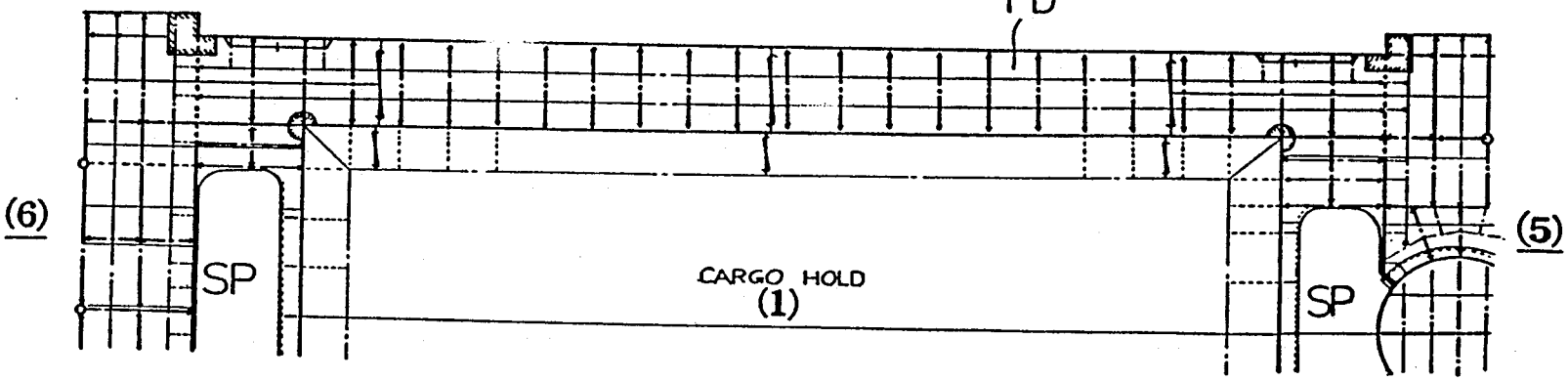
Figure 16:
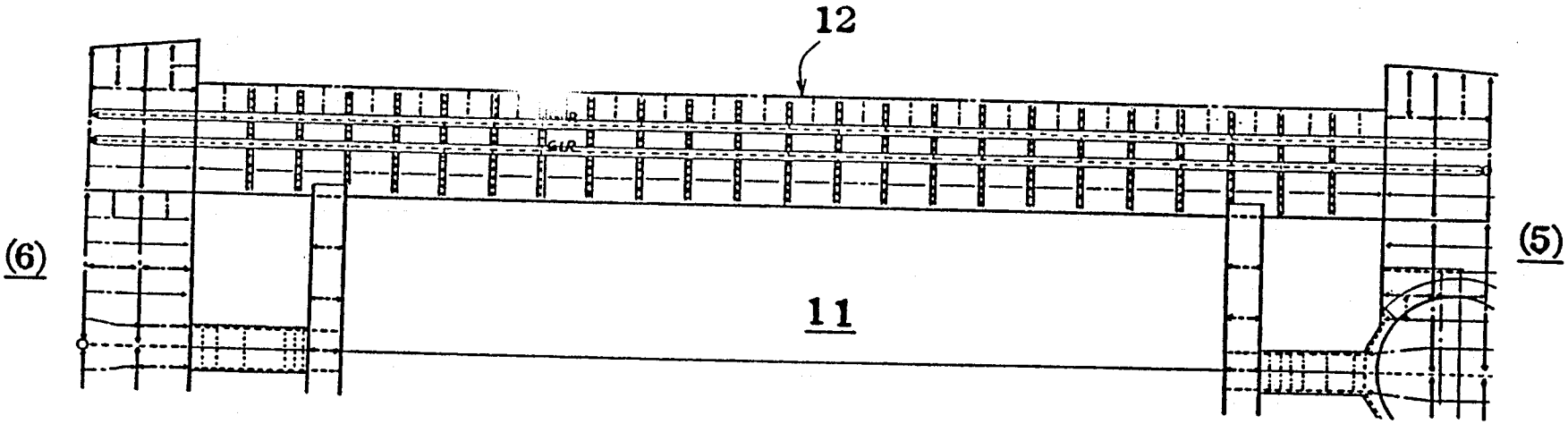
Figure 17:
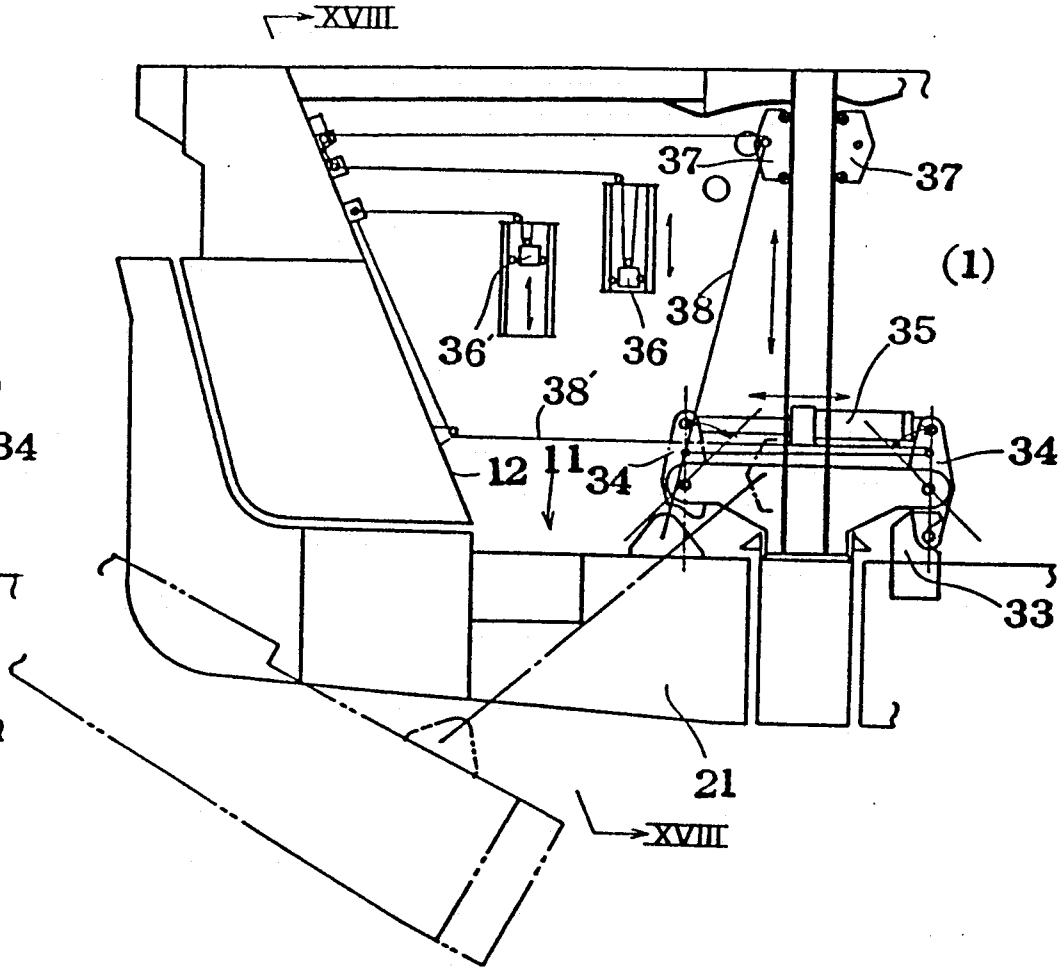
FIG. 17 is a side cross section showing equipment for opening and closing the doors.

While the hold part (1), located in the middle section, has cylinder spaces SP, at the front and back of which the equipment mentioned below to open and close the doors is located, a hatch HA is formed on the upper deck UD, as shown in FIG. 8. As shown in center section, FIG. 12, the hull side walls 12 which form a double-hull construction, form the upper deck UD and the freeboard FD which run, as a whole, from stem (5) to stern (6), as a full double deck. FIG. 13 and FIG. 14 show the construction profile of the upper deck UD and the freeboard deck FD.

Figure 4:
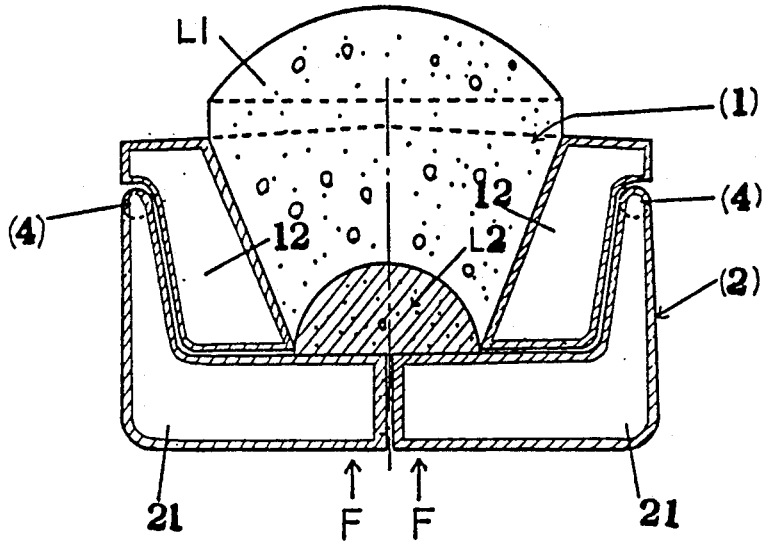
FIG. 4 is a conceptual view illustrating the basic function of hopper barge carrier vessel as embodied in the second structure of this invention.
Figure 5:
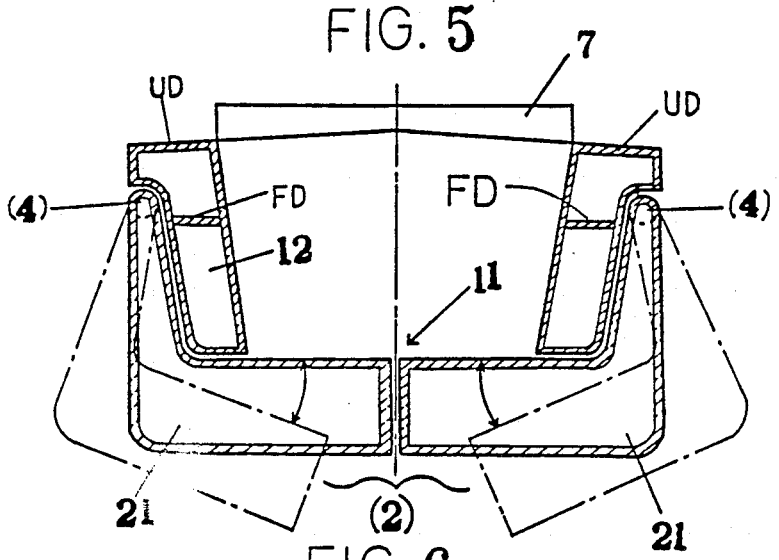
FIG. 5 is a conceptual view illustrating the basic function of hopper barge carrier vessel as embodied in the third structure of this invention.

As shown in FIG. 4, it is basically sufficient that said hold side walls 12 form a taper so that the inside of said side walls receives the greatest component of total load, L1. Yet, concretely, as shown in FIGS. 7 and 13, both sides of the side walls only slope in a taper between upper deck UD and freeboard deck FD not only both sides but also the front and back side walls taper to form a funnel-shaped cargo area CA, similar to the reverse trapezoid. Therefore, the load space L2 bearing on the opening and closing doors at the hold is lessened.

Figure 11:
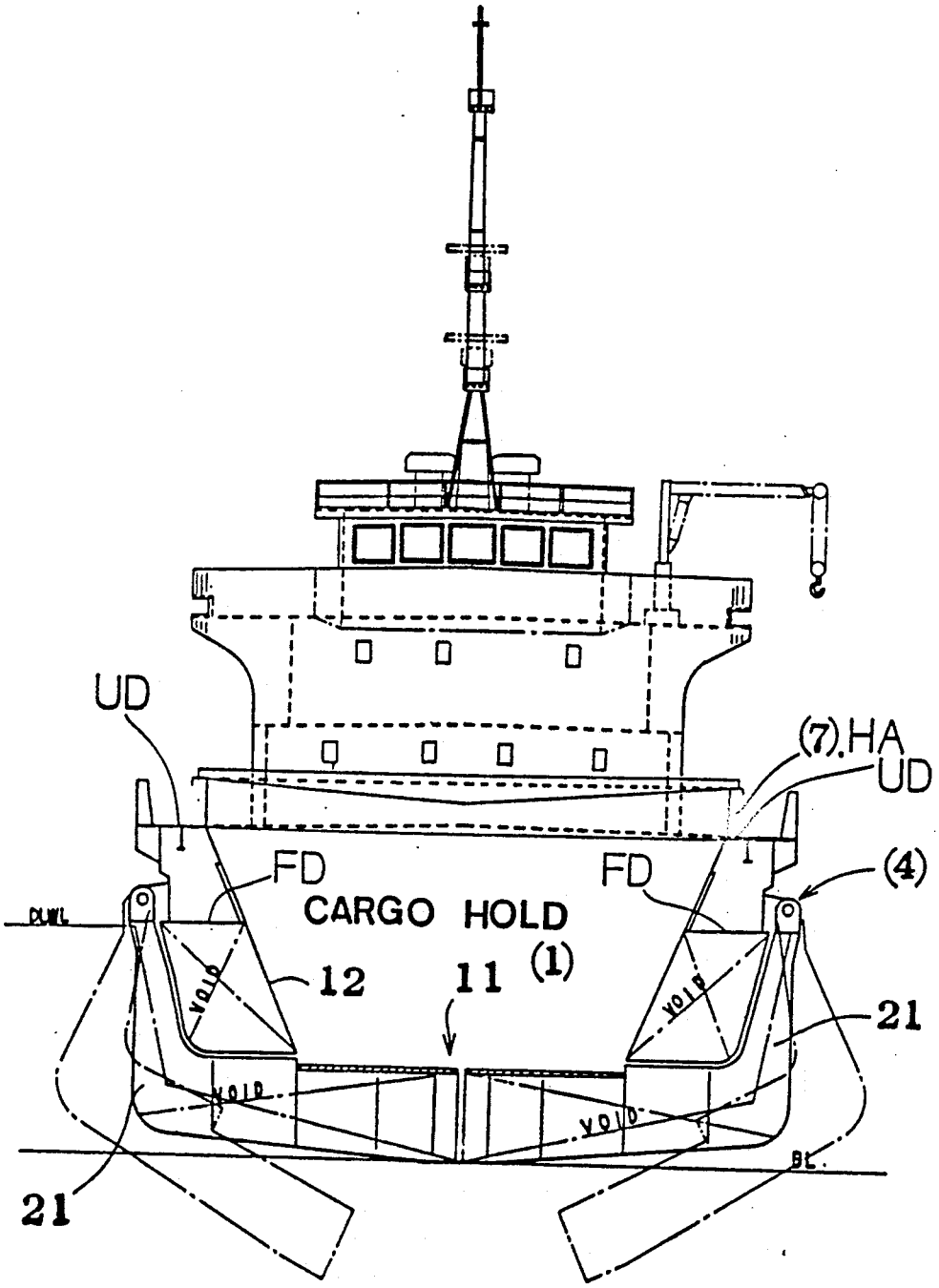
Figure 12:
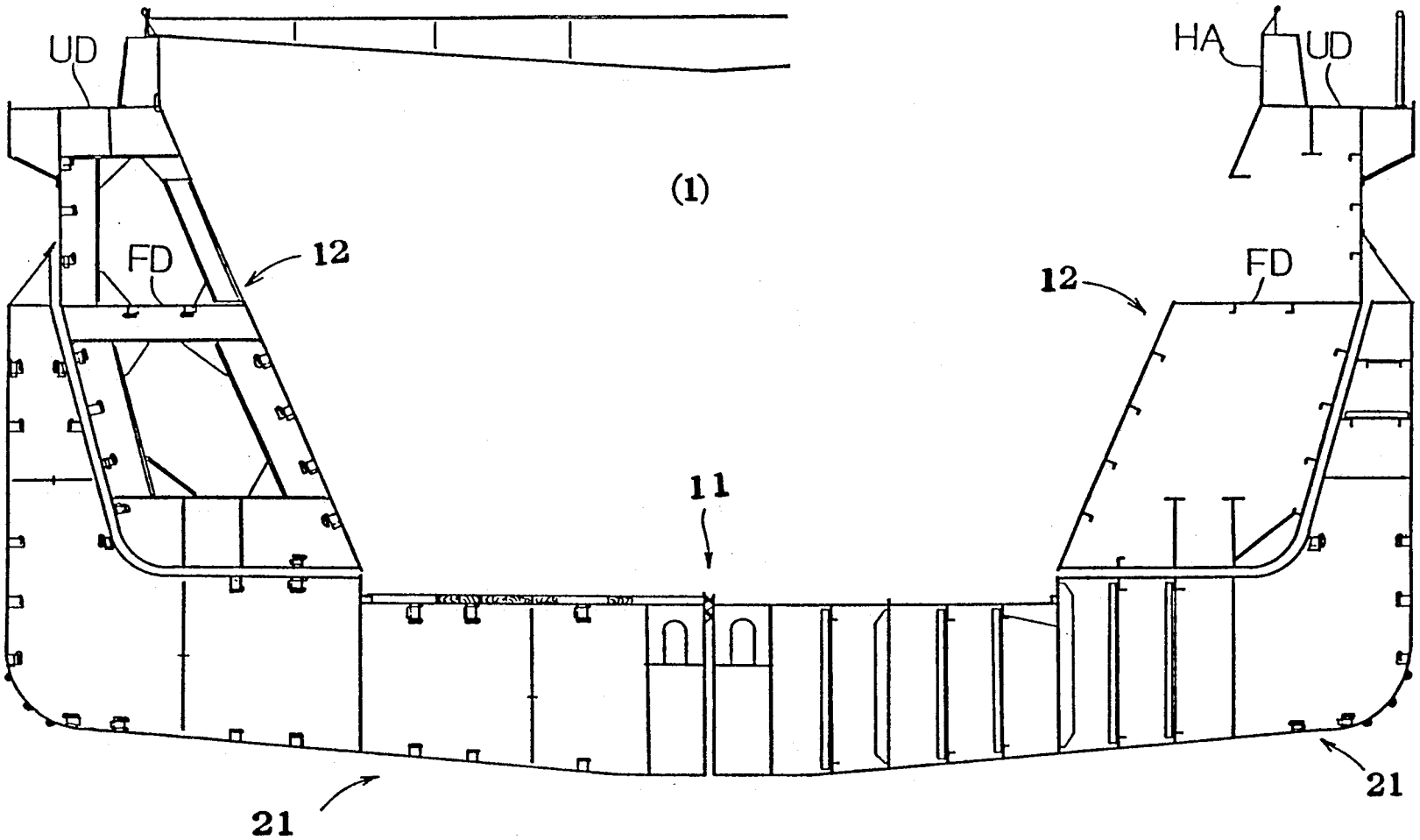
FIG. 12 is a center side cross section illustrating hull construction with the left half showing the wave frame section and the right half showing the ORD frame section.

On the other hand, the door structure (2) to open and close said released bottom part 11 is, as shown in FIG. 11, connected, at its upper edges, to the upper position on freeboard FD on both outside walls of said side walls by hinges. Thus, in a sense, the double bottom structure below the freeboard deck of a carrier vessel with a double deck structure is divided into right and left sections at the bottom center of the load space section and forms a pair of float-type door constructions, each with an L-shaped longitudinal section, which open and close to the right and left. Therefore, while the inside walls of a pair of right and left double structural door parts 21, 21, each with an L-shaped section, are formed to curve alongside the outside walls of said hold side wall 11, their outside walls ordinarily formed in a hull shell plate curve so that they match the shell plate at the stem (5) and stern (6). This door part 21, 21 closes to hold the released bottom 11 of said cargo space, and it provides buoyancy to lift the center of the released bottom part where loaded cargo rests. In short, because, as shown in FIG. 4, the pair of doors 21, 21 is of a double bottom structure and, below the water line, a float-condition is formed as a whole, the door closing force F which said float receives from the sea and the load L2 which presses on the door part are constituted to press against each other almost reciprocally.

Figure 6:
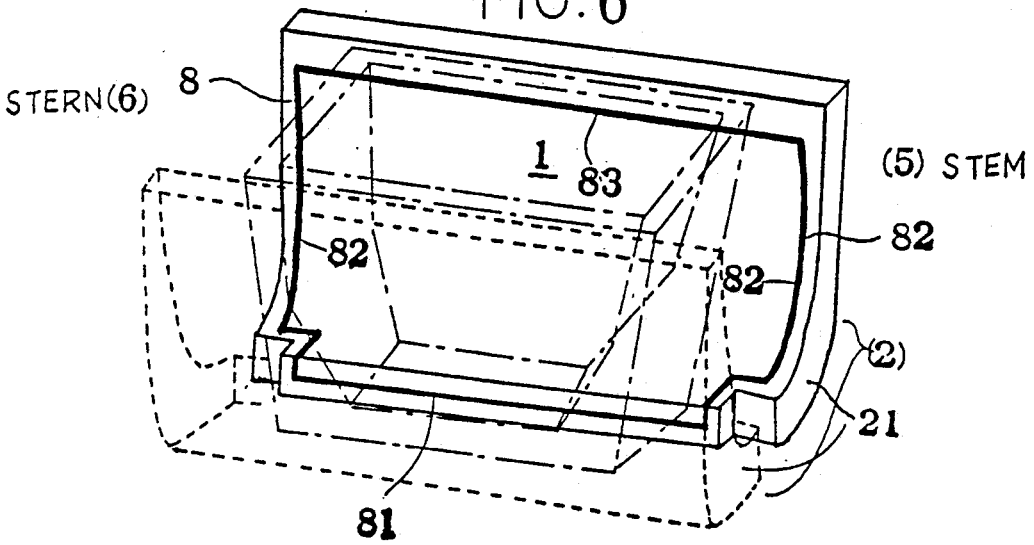
FIG. 6 is a conceptual view illustrating the basic function of hopper barge carrier vessel as embodied in the fourth structure of the invention.

In addition, said hold side wall 11 released at the bottom and said pair of doors 21, 21 are, as shown in FIG. 6, watertight constructions in the hull, including the hold when the bottom part is closed. In other words, packing member (8) is provided at the tip parts 21, 21, the edge 81 of said packing member is pressed against the edge of the opposite door part, while the edge 82, extending lengthwise inside the door part, is pressed against the members of connecting sections of stem (5) and the stern (6), and the edge 83, expanding sideways, is pressed against the outside walls of the hold and the like. Thus the hull becomes a completely watertight structure from stem (5) to stern (6).

Said pair of door parts 21, 21 opens and closes to the right and left. The equipment for opening and closing the doors (3), (3) is provided in cylinder spaces SP, located at the front and back of said hold (1), so that the driving force to open and close the doors works in a well-balanced way.

Figure 18:
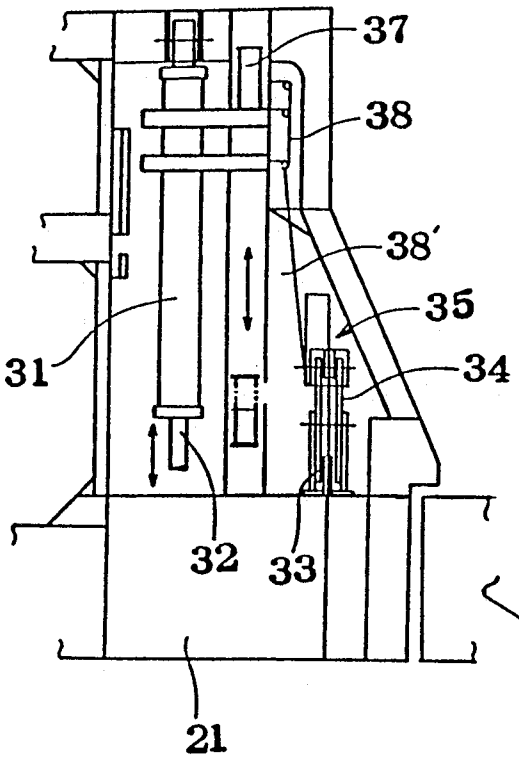
FIG. 18 shows said equipment from an line XVIII—XVIII in FIG. 17.
Figure 20:
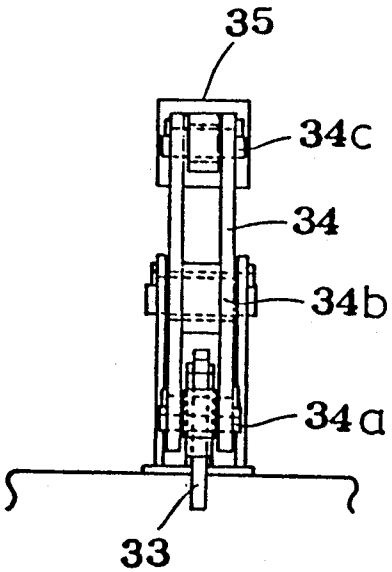
FIG. 20 is a side view of said equipment seen in FIG. 19.
Figure 19:
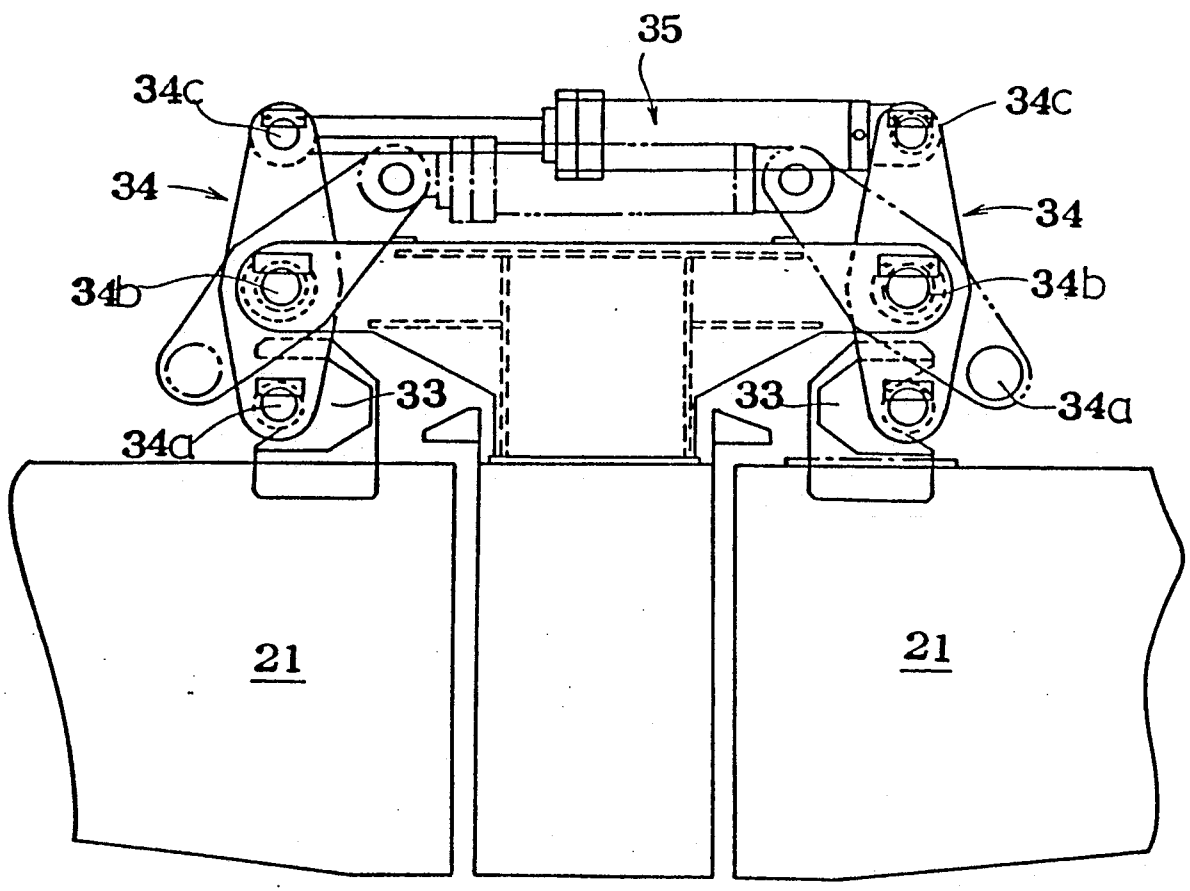
FIG. 19 is a front view showing equipment used to join the doors.
Figure 21:
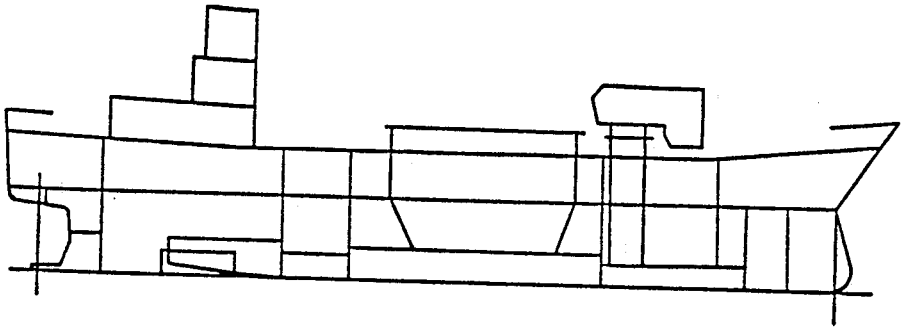
FIGS. 21 through 28 show the functions of a carrier vessel produced on the basis of the present invention.
Figure 22:
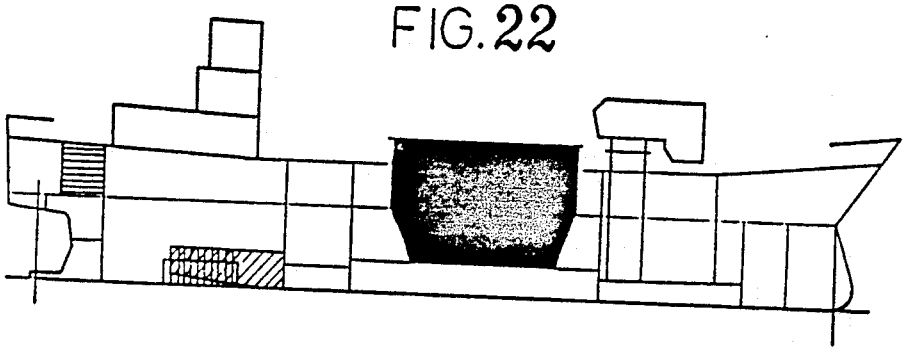
Figure 23:
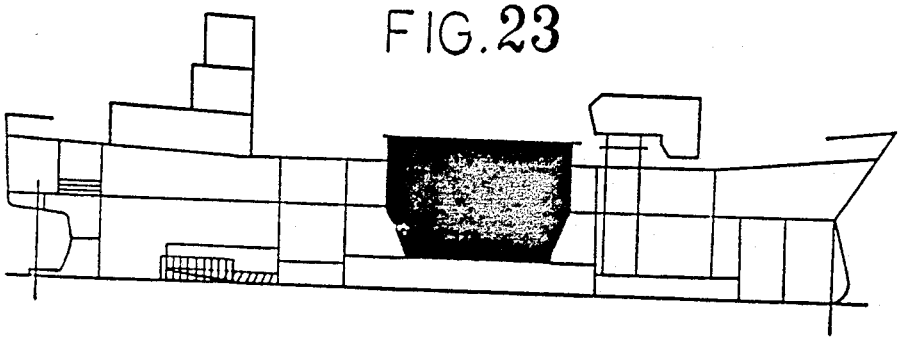
Figure 24:
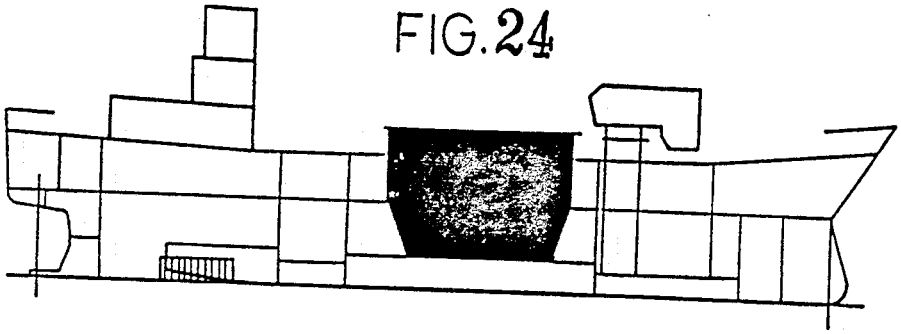
Figure 24:
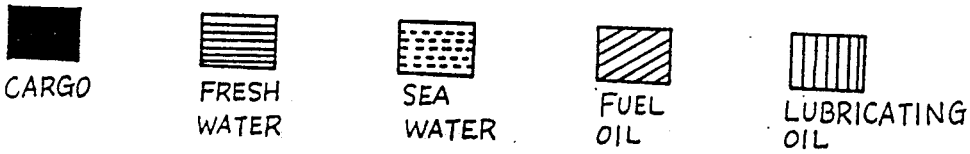
Figure 25:
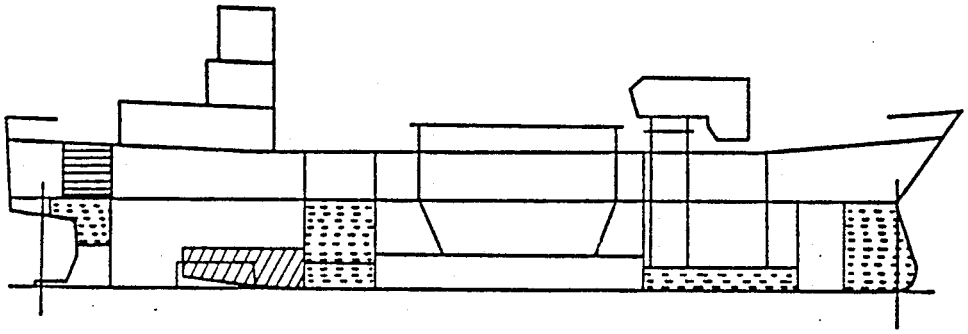
Figure 26:
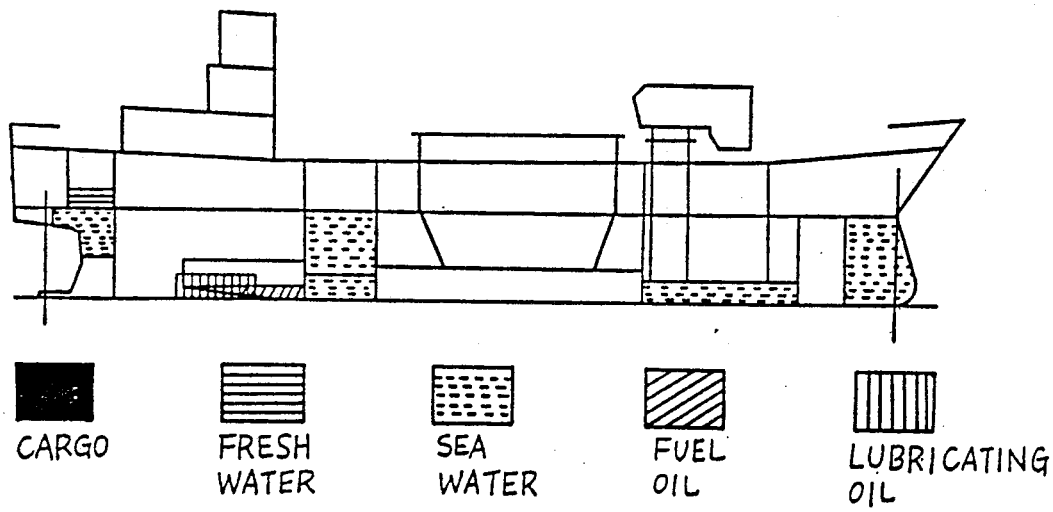

Said equipment for opening and closing the doors is shown in FIGS. 17 to 20. As shown in FIG. 18, a pair of oil pressure cylinders 31, 31 for opening and closing are supported rotatably at the upper tips and hang down perpendicularly. The tips of rods 32 are connected to each door 21, and, by their expansion and contraction, the rods 32 open and close a pair of doors 21, 21 to the right and left. Engaged parts 33, 33, which have a " " shape, are also, provided, facing outward, as shown in FIG. 19, at the pair of right and left doors. In addition, door attachment equipment is provided, which consists of engaged lever 34, revolved and operated by attachment oil pressure cylinder 35 at the end part 34*c*, the fulcrum of which is a supported by a rotatable center part 34*b*, with free end part 34*a* engaged rotatably to engaged part. Using the said door attachment equipment, while the pair of closed doors 21, 21 is kept closed by contraction of attachment oil pressure cylinder 35 to engage the engaged lever 34 and the engaged part 33, the pair of doors 21, 21 is released by extention of the attachment oil pressure cylinder 35 to disengage said engaged part 33 of the door part and the engaged lever 34. Furthermore, to ensure smooth and sure opening, closing and attaching the releasing of said pair of doors 21, 21, a balance weight 36′ for attachment is provided. The balance weight for opening and closing is attached at required points to the pair of doors 21 by stainless steel wire cable 38 through equalizer block 37 which ascends and descends in accordance with door opening and closing. The balance weight 36′ for attachment is attached at required points to the engaged lever 34 by stainless steel wire cable 38′. Moreover, the opening, closing and attaching and releasing of said doors is operated automatically by location detection using limit switches provided at required points.

In said constitution of the hull construction, earth, sand, quarried stones and the like are loaded in the hold (1), the pair of doors 21 are closed 21 using the open-close cylinder 31 of said door opening closing equipment (3) and keeping the door closed by attachment cylinder 35, and so on. Then, as shown in FIG. 4, of the perpendicular load of cargo, the greater part of the perpendicular load L1 will bear on the slope of the side walls, and the remaining perpendicular load will weigh on the loading side of the pair of doors 21, 21. However, because the pair of doors 21, 21 are float-shaped, and, in a fully loaded condition, are located below the water line, the load weighing on the loading side of said pair of doors 21, 21 will be mitigated due to the buoyancy F pushing up the center of the released bottom 11. On account of this, a watertight condition is maintained in the hold, and the stress on the hinge structure of the door section is significantly reduced.

Thus, because a carrier vessel carrying earth, sand and the like consists of a single body from stem (5) to stern (6) with side walls of a double-steel-hull construction, it can transport earth and sand to a given destination under ordinary sail without any trouble, even though it has said hull construction for cargo disposal at sea.

For cargo disposal into the sea at a given destination, attachment cylinder 35 disengages the engaged lever 34 from the pair of doors 21, 21; opening-closing cylinder 31 then spreads the pair of doors 21, 21 to the right and left. Thus, the cargo slides down along the slope of the hold. After disposal, the pair of doors 21, 21 is ready to return to the prior condition thanks to their buoyancy. Opening-closing cylinders 31 are therefore contracted so that the released bottom part 11 of the hold (1) is easily closed.

SPECIFICATIONS OF A CARRIER VESSEL AS SPECIFIED IN THE INVENTION

After the carrier vessel shown in FIGS. 7 to 20 was constructed, its properties were examined. The results are shown in Tables 1 and 2.

TABLE 1

| condition | | light | full load departure | full load 80% consumption | full load entry | empty departure | empty entry |
|---|---|---|---|---|---|---|---|
| constant item | t | 0 | 9.22 | 9.22 | 9.22 | 9.22 | 9.22 |
| provisions | t | 0 | 0.50 | 0.10 | 0 | 0.50 | 0.10 |
| fuel oil | t | 0 | 55.00 | 11.00 | 0 | 55.00 | 11.00 |
| fresh water | t | 0 | 30.92 | 6.18 | 0 | 30.92 | 6.18 |
| sea water | t | 0 | 0 | 0 | 0 | 373.17 | 371.17 |
| cargo | t | 0 | 2002 | 2002 | 2002 | 0 | 0 |
| dead-weight capacity | t | 0 | 2098 | 2028 | 2011 | 468 | 400 |
| light weight | t | 1195 | 1195 | 1195 | 1195 | 1195 | 1195 |
| displacement | t | 1195 | 3293 | 3223 | 3206 | 1663 | 1163 |
| equivalent draft | m | 1.95 | 4.72 | 4.64 | 4.62 | 2.95 | 2.50 |
| mean draft | m | 1.98 | 4.71 | 4.63 | 4.61 | 2.64 | 2.52 |
| stem | | 1.37 | 4.09 | 4.23 | 4.24 | 1.72 | 1.94 |
| stern | | 2.59 | 5.33 | 5.05 | 4.98 | 3.55 | 3.11 |
| trim | m | 1.22 | 1.24 | 0.83 | 0.74 | 1.83 | 1.17 |
| MTC | t-m | 24.48 | 37.03 | 36.35 | 36.17 | 25.36 | 25.21 |
| TPM | t | 7.20 | 8.05 | 8.02 | 8.01 | 7.31 | 7.29 |
| OG | m | 0.71 | 0.17 | −0.32 | −0.44 | 1.05 | 0.11 |
| OB | m | −1.78 | −1.22 | −1.26 | −1.27 | −1.74 | −1.74 |
| OF | m | −1.68 | 0.68 | 0.58 | 0.55 | −1.58 | −1.60 |
| KM | m | 9.55 | 6.01 | 6.02 | 6.02 | 7.65 | 7.84 |
| KG | m | 4.79 | 4.99 | 5.03 | 5.05 | 4.00 | 4.04 |
| GM | m | 4.76 | 1.02 | 0.99 | 0.97 | 3.65 | 3.80 |
| GG | m | 0 | 0.02 | 0.01 | 0 | 0.03 | 0.02 |
| GM | m | 4.76 | 1.00 | 0.98 | 0.97 | 3.62 | 3.78 |

FIGS. 21 to 26 illustrate load conditions of cargo, sea water, fresh water, fuel oil under light load condition, full load condition (departure, 80% consumption, entry), and empty condition (departure, entry).

TABLE 2

| | | | | |
|---|---|---|---|---|
| draft | stem | 1830 | displacement | 1634.2t |
| | stern | 3320 | trim | 1490 |
| | mean | 2578.5 | Cb | 0.685 |
| principal dimensions | Lpp × B × D × d = 65.00m × 14.00m × 6.80m/4.80m × 4.71m | | | |

speed test

| output | mean speed | number of revolutions |
|---|---|---|
| 50% | 11.139 | 254 rpm |
| 75% | 12.224 | 291 |
| 100% | 12.763 | 320 |

| steering test (100%) | steering wheel |
|---|---|
| from rudder center to 30 degrees port | 8.5 sec |
| from 35 degrees port to 30 degrees starboard | 19.2 |
| from rudder center to 30 degrees starboard | 10.0 |
| from 35 degrees starboard to 30 degrees port | 19.0 |
| from 35 degrees to rudder center | 10.1 |

turning trial (100%)

| left turn | | | right turn | | |
|---|---|---|---|---|---|
| steering angle | 35° | | steering angle | 35° | |
| steering time | 1.5 sec | | steering time | 1.5 sec | |
| command hull | 5° | turn | 10.7 sec | | 9.2 |
| | 30° | | 22.9 | | 21.8 |
| | 90° | | 48.2 | | 49.0 |
| | 180° | 1 min | 29.4 sec | 1 min | 34.4 sec |
| | 360° | 3 | 6.1 | 3 | 10.1 |
| tactical diameter 240m angle of rake 1° 271.5 m 1° | | | | | |

forward and reverse trial (100%) → (75%)

| number of revolutions in forward and reverse | number of revolutions in reverse |
|---|---|

TABLE 2-continued

| 320 rpm | 291 rpm |
|---|---|
| after command for maximum reverse | |
| engine stop | 7.5 sec |
| start of reversing propeller | 11.8 |
| hull stop | 1 min 34.3 |
| angle of revolution when hull stops | 2° |

Figure 27:
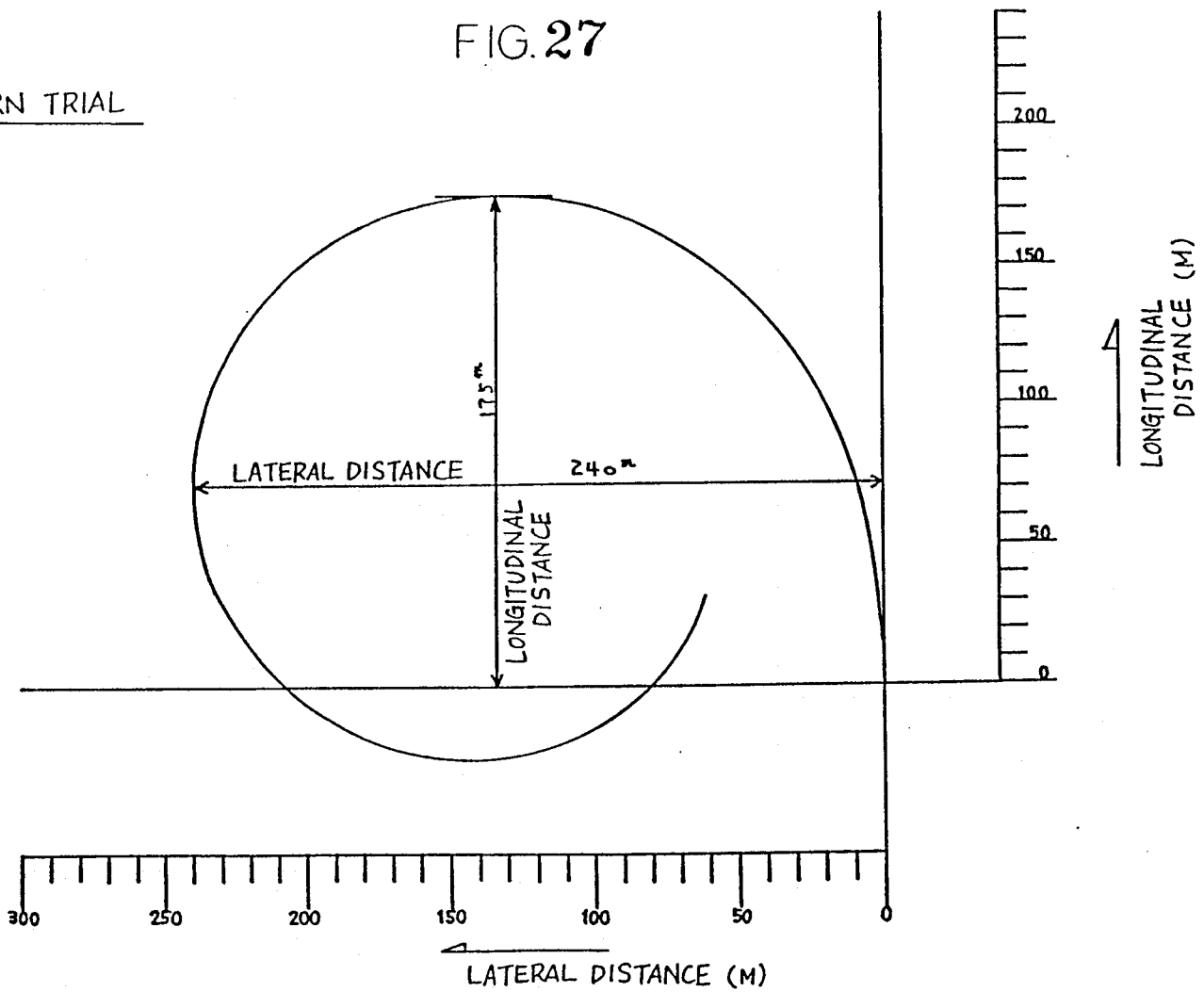
Figure 28:
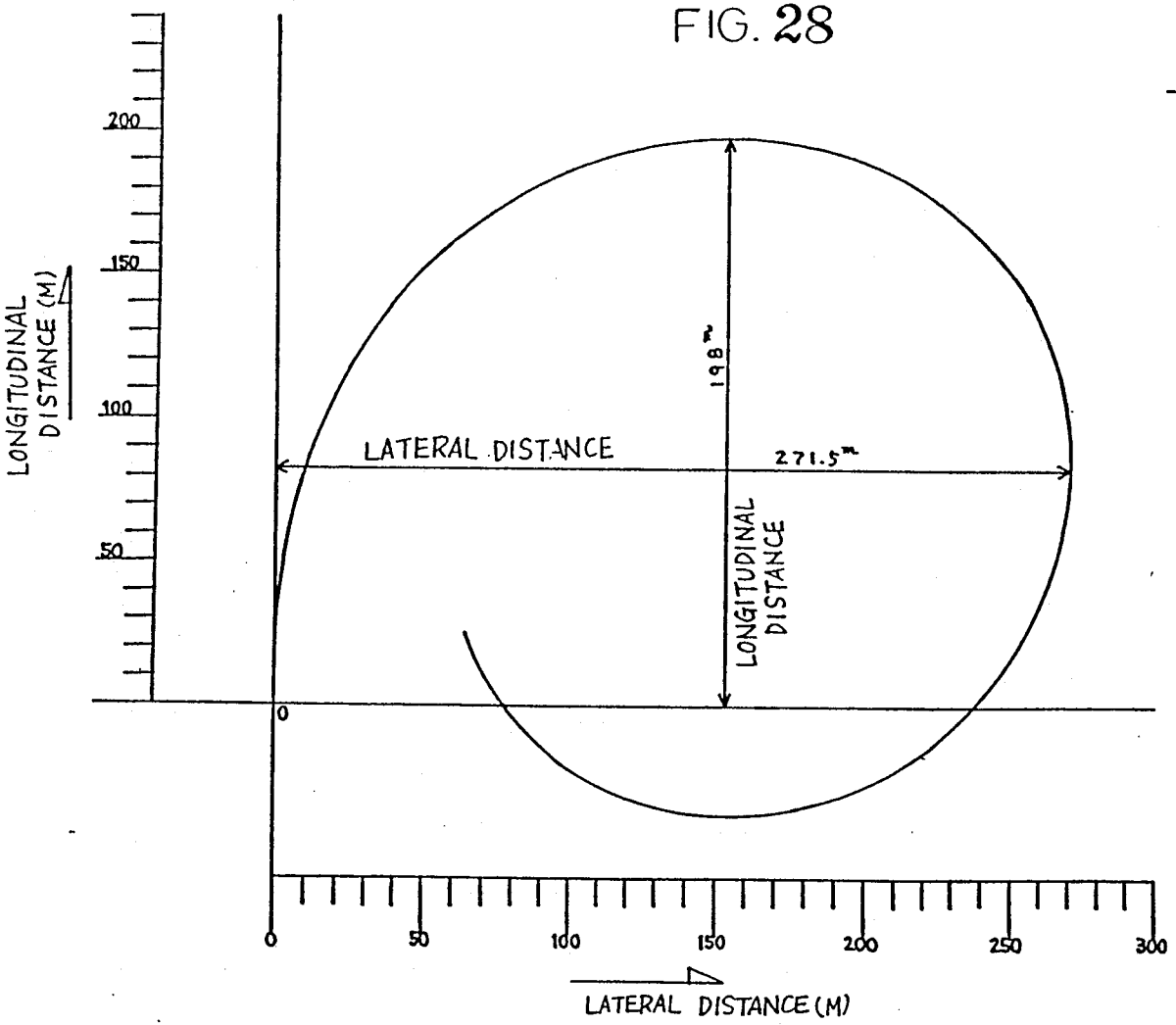
Figure 29:
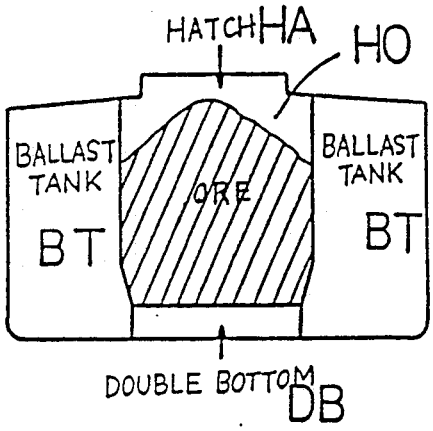
FIG. 29 PRIOR ART
FIGS. 29 through 31 are cross sections showing hold conditions in a conventional ore carrier, a grain carrier and an ore bulk oil carrier.
Figure 30:
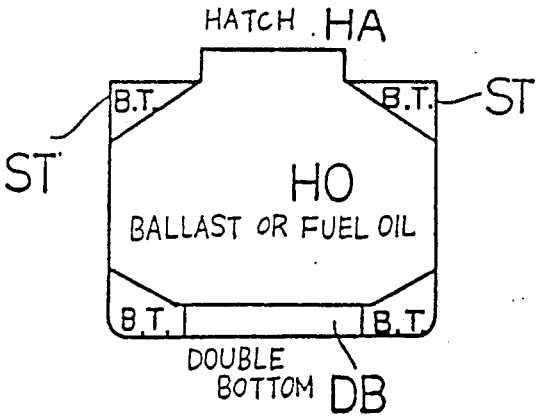
FIG. 30 PRIOR ART
Figure 31:
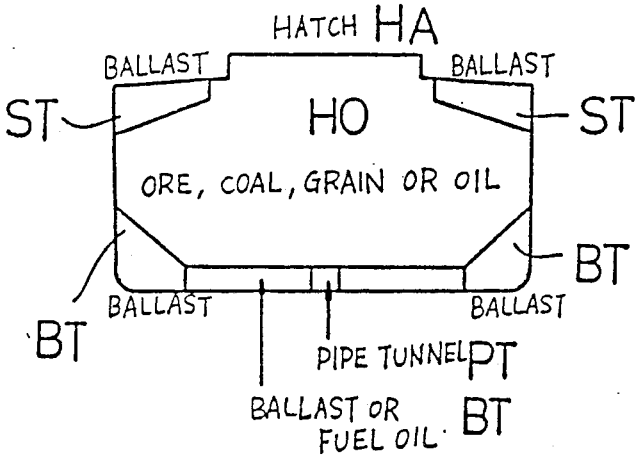
FIG. 31 PRIOR ART

FIGS. 27 and 28 show graphs depicting conditions in left-turn and right-turn trials.

As is apparent from the explanation above, according to the first structure of the present invention in which, instead of separating the hull itself, a double-hull construction of side walls constitutes a single hull construction from stem to stern and a released bottom, connected by hinges at the upper parts to both outsides of side walls of said hold so that the protruding amount does not become large like conventional hopper barge vessels. The pair of right and left doors are opened and closed sideways and have an L-shaped section, which curve alongside the released bottom. The cargo-disposal structure can be applied to the hull construction of vessels with self-propelling capacity and is especially useful for sea construction work because it constitutes a cargo-unloading structure on the sea, thus overcoming various defects in the conventional method.

Moreover, according to the second structure of the present invention, the inside of the hold side walls slopes in a taper so that the greatest component of perpendicular cargo load bears on said walls and perpendicular load on the pair of the doors is mitigated, and the pair of doors have a buoyant structure like a float, etc., so that stress on the door hinge structure and driving means is mitigated, and, consequently, the cost for equipment can be reduced.

According to the third structure of the present invention, a hold of double hull construction is constituted to become a double deck or a multi-deck, and as a whole, a single-hull-double-deck structure or a multi-deck structure is constituted. The hull, of double-hull construction, is divided into right and left halves at the middle of the bottom so that a pair of right and left float door structures with an L-shaped longitudinal section can open and close to the right and left. Because the external hull appearance below the water line is constituted to be a single body from stem to stern, a single-hull-double-deck or multi-deck can be applied to a hopper barge carrier vessel, the loading capacity of which is large, and which can sail at a speed equal to that of an ordinary carrier vessel.

According to the fourth structure of the present invention, in a hopper barge hull construction, L-shaped parts are capable of attaching completely to the outside of the side walls and sealing, from both sides and from the mouth of the released bottom 11 of side walls 12 of the hold with a double-hull construction forming a reversed trapezoidal cargo space. Furthermore, a packing member is provided around the inner edge of a pair of right and left float-shaped doors so that the force to close the doors is received from the sea at said float-shaped door structure and presses the doors connected parts against the stem, the stern, the outside of the hold and the door tip parts facing the force. Thus, a completely watertight structure is provided as is usually required for a carrier vessel.

According to the fifth structure of the present invention, while door-opening and closing equipment is provided at the front and back of the hold, and opening and closing cylinders open and close a pair of right and left doors with an L-shaped section which are connected by hinges and which curve alongside the released bottom and which open and close sideways, engaged parts with "ɔ" shape are provided at each door. With engaged levers rotated by tightening the cylinders, the engaged part of said pair of right and left doors is pressed and held. While said pair of right and left doors are kept closed and held, the pair of doors is released by disengaging the engaged part of said door part and the engaged levers. In this way, opening and closing the doors and maintaining them in a closed condition are ensured and operation is facilitated.

Therefore, according to the present invention, as prooved by specifications tests, an epoch-making carrier vessel for sand, quarried stones and so on can be provided, which has specifications equal to an ordinary carrier vessel and the bottom of which also opens and closes.

Furthermore, explanations have been presented, taking a carrier vessel with self-propelling capacity as an example, but it is a matter of course that the present invention can be applied to equipment of buoyant structures without self-propelling capacity.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A hopper barge hull construction comprising:

a single body structure having a stem section, a stern section and a side wall section therebetween, said side wall section forming a hold having an outlet defined in a bottom portion thereof for discharge of cargo, the stem section and the stern section having a closed bottom and the outlet in the side wall section being located between the stem section and the stern section;

a pair of L-shaped doors for closing the outlet in the side wall section, said doors being movable between an open position opening the outlet and a closed position closing the outlet, each door having a forward side adjacent the stem section and a rearward side adjacent the stern section each L-shaped door having a first leg which closes the opening when in the closed position, and a second leg positioned laterally outwardly of the side wall section;

hinge means for pivotably attaching each of the doors of the pair of doors to the side wall section; and drive means for pivoting the doors between the open position and the closed position, said drive means being provided at least at one of a position near the forward and rearward sides of the pair of doors.

2. The hopper barge construction as recited in claim 1, wherein the hold is a double-hull construction and wherein side walls of the side wall section taper downwardly on the inside of the hold whereby a greater component of the load of the cargo held in the hold is received by the side walls than by a bottom of the hold, the bottom of the hold being formed by the L-shaped doors when the doors are in the closed position, each door having an inner side face which contacts an outer face of the side walls of the hold when said doors are in the closed position, said doors each having a tip edge portion which abuts when the doors are in the closed position, said doors further having an outer side face and a bottom face which float and which use buoyancy to offset the load received from the cargo on the doors.

3. The hopper barge construction as recited in claim 1, further comprising means for water-tight sealing the outlet when the doors are in the closed position, the sealing means comprising a packing member provided on an inner side face of the doors and along periphery edges of the doors including abutting tip edge portions of the doors when the doors are in the closed position.

4. The hopper barge construction as recited in claim 2, further comprising means for water-tight sealing the outlet when the doors are in the closed position, the sealing means comprising a packing member provided on the inner side faces of the doors and along periphery edges of the doors including the tip edge portions thereof.

5. The hopper barge construction as recited in claim 1, wherein said drive means comprises:

cylinders for pivotably opening and closing each of the doors, said cylinders being provided at the front and the back of the hold;

engaging means for locking and unlocking the doors to thereby hold the doors in the closed position when locked, said engaging means comprising an engaging part fixed to each of the doors, pivotable levers for engaging each engaging part when pivoted to a locked position and a device connected to the levers for pivoting the levers between the locked and an unlocked position; and means for ensuring opening and closing of the doors, for maintaining the doors in the closed position and for releasing the doors before the doors are moved to the open position, said means for ensuring including a plurality of balance weights, one of the weights being operatively attached to at least one of the doors.

6. The hopper barge construction as recited in claim 5, wherein the device for pivoting the levers of the engaging means is a cylinder.

7. The hopper barge construction as recited in claim 5, wherein the plurality of balance weights comprises;

at least one first weight connected via a first wire to one of the pivotable levers, said first weight maintaining the lever in a locked position until said doors are to move to the opened position; and at least one second weight connected to a tip edge portion of one of the doors by a second wire to thereby urge said door to the closed position.

8. The hopper barge construction as recited in claim 7, wherein two first weights are used, each first weight being connected by a first wire to one of the pivotable levers and wherein two second weights are used, each second weight being connected by a second wire to one of the tip edge portions of the doors.

9. The hopper barge construction as recited in claim 5, wherein said drive means further comprises a plurality of limit switches for detecting the location of the doors.

10. The hopper barge construction as recited in claim 1, wherein the hold is a double-hull construction of one of a double-deck and multi-deck extending between the stem section and stern section.

* * * * *